US008084948B2

(12) United States Patent
Van Der Veen et al.

(10) Patent No.: US 8,084,948 B2
(45) Date of Patent: Dec. 27, 2011

(54) METHOD FOR DIMMING A LIGHT GENERATNG SYSTEM FOR GENERATING LIGHT WITH A VARIABLE COLOR

(75) Inventors: Geert Willem Van Der Veen, Eindhoven (NL); Wijnand Johannes Rietman, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 520 days.

(21) Appl. No.: 12/296,942

(22) PCT Filed: Apr. 4, 2007

(86) PCT No.: PCT/IB2007/051211

§ 371 (c)(1), (2), (4) Date: Oct. 13, 2008

(87) PCT Pub. No.: WO2007/116349

PCT Pub. Date: Oct. 18, 2007

(65) Prior Publication Data

US 2009/0179587 A1 Jul. 16, 2009

(30) Foreign Application Priority Data

Apr. 11, 2006 (EP) ..... 06112498

(51) Int. Cl.

| | |
|---|---|
| ***H05B 37/02*** | (2006.01) |
| ***H05B 39/04*** | (2006.01) |
| ***H05B 41/36*** | (2006.01) |
| ***G05F 1/00*** | (2006.01) |
| ***G05F 37/00*** | (2006.01) |

(52) U.S. Cl. ..... 315/151; 315/324; 315/308; 362/231

(58) Field of Classification Search ..... 315/151, 315/294, 308, 295, 297, 112, 149, 219, 169.3; 307/31; 362/555, 231, 276; 345/82–84, 345/102

See application file for complete search history.

(56) References Cited

U.S. PATENT DOCUMENTS

| | | | | |
|---|---|---|---|---|
| 5,350,977 | A * | 9/1994 | Hamamoto et al. | 315/291 |
| 5,384,519 | A * | 1/1995 | Gotoh | 315/324 |
| 5,418,432 | A * | 5/1995 | Takeuchi et al. | 315/151 |

(Continued)

OTHER PUBLICATIONS

Anonymous: "Hue & Chroma Colour Setting Method" Internet Citation, Technical Disclosure, [Online] Jun. 30, 2004, XP002378520.

*Primary Examiner* — Swaki S Ismail
*Assistant Examiner* — Dylan White
(74) *Attorney, Agent, or Firm* — John F. Salazar; Mark L. Beloborodov

(57) ABSTRACT

A method for dimming an illumination system (20) capable of emitting light (L) with a variable color is described. The illumination system (20) comprises three dimmable light sources (21, 22, 23) generating respective lights (L1, L2, L3) having respective, mutually different colors (C1, C2, C3). The method comprises the step of reducing the light intensities (I1, I2, I3) of the three dimmable light sources (21, 22, 23) while maintaining the color point until one of said light sources (21) reaches a lower dim limit ($I_{MIN}$)—The method further comprises the step of maintaining the light intensity (I1) of said one light source (21) at its lower dim limit ($I_{MIN}$) and reducing the light intensities (I2, I3) of the two other dimmable light sources (22, 23) in such a manner that the hue is maintained.

3 Claims, 5 Drawing Sheets

U.S. PATENT DOCUMENTS 6,441,558 B1 * 8/2002 Muthu et al. ..... 315/149
6,507,159 B2 * 1/2003 Muthu ..... 315/307
6,538,371 B1 * 3/2003 Duggal et al. ..... 313/486
7,012,382 B2 * 3/2006 Cheang et al. ..... 315/291
7,135,664 B2 * 11/2006 Vornsand et al. ..... 250/205
7,144,130 B2 * 12/2006 Toyota et al. ..... 362/230
7,893,631 B2 * 2/2011 Speier ..... 315/308
7,893,916 B2 * 2/2011 Wei ..... 345/102
2004/0246742 A1 12/2004 Toyota et al.
2004/0264186 A1 * 12/2004 Tabell ..... 362/231
2004/0264193 A1 * 12/2004 Okumura ..... 362/276

* cited by examiner

METHOD FOR DIMMING A LIGHT GENERATNG SYSTEM FOR GENERATING LIGHT WITH A VARIABLE COLOR

FIELD OF THE INVENTION

The present invention relates in general to an illumination system for generating light with a variable color, and more particular to a control system for driving an illumination system comprising three fluorescent lamps of mutually different colors.

BACKGROUND OF THE INVENTION

Systems for generating light with a variable color are already known. By way of example, reference is made to U.S. Pat. No. 5,384,519, which describes a system with three individual light sources, each light source producing light with a specific color, the three specific colors being mutually different. The light produced by the system as a whole contains a mixture of the light produced by three individual light sources, and the color of the light mixture is a mixture of the three specific colors. For varying the color of the light mixture, the relative light intensities of the three individual light sources can be set at a certain ratio.

Each of the light sources has a nominal output power, and each of the light sources can be dimmed such that the actual light output power of such light source is lower than the nominal output power. Setting the relative light intensities of the three individual light sources is done by adequately setting the respective dim factors of the three light sources.

Having set the color of the light mixture as desired, the output intensity of the system as a whole can be varied while keeping the color constant. To this end, the light intensities of the three individual light sources are varied, such that the ratio of the relative light intensities is maintained constant in order to keep the color constant. A problem in this respect is that the light intensity of each light source can only be varied within a certain range defined by a minimum intensity level and a maximum intensity level, which maximum intensity level typically corresponds to the nominal intensity. The maximum output intensity of the system as a whole is reached when the light source having the highest relative intensity reaches its maximum intensity level: a further increase in intensity is not possible for this light source. The minimum output intensity of the system as a whole is reached when the light source having the lowest relative intensity reaches its minimum intensity level: a further decrease in intensity is not possible for this light source. The variable intensity range is largest for colors where the light intensities of the three individual light sources are substantially equal. The variable intensity range is lower for colors where the light intensities of the three individual light sources differ greatly. The variable intensity range is lowest for colors close to the outer edges of the color gamut.

In said document U.S. Pat. No. 5,384,519, a system is disclosed for obtaining a specific desired output color at a certain desired dim level. Corresponding control signals for the three light sources are taken from a memory, and the three light sources are controlled by the three corresponding control signals as read from memory. Then, the actual output light is measured, and it is checked whether the actual output light is in conformity with the settings. If it is found that a first one of the light sources produces not enough light, the control signals for the other two light sources are adapted such that the light outputs of the other two light sources are reduced, in such a manner that the mixture has the desired color; however, a consequence is then that the intensity of the mixture light is less than expected.

If one of said other two light sources is at its minimum intensity, reducing the light output of this one light source is not possible. Then, the control signal for the said first one of the light sources is adapted such that the light output of this first light source is increased, and the control signals for the other two light sources are adapted, such that the desired color ratio is obtained and hence the mixture has the desired color; however, a consequence is then that the intensity of the mixture light is higher than expected. Thus, this publication aims at keeping the color point constant but at the expense of sacrificing the light intensity.

The present invention aims to solve or at least reduce the above problems. More particularly, the present invention aims to provide a light generating system which can be dimmed over an extended dim range while maintaining the color.

SUMMARY OF THE INVENTION

According to an important aspect of the present invention, when the light source having the lowest relative intensity reaches its minimum intensity level and further dimming is desired, the output intensity of the other two light sources is reduced but the output intensity of the said light source at its minimum intensity level is maintained constant, in such a way that the hue remains constant. As a result, although the actual color of the light mixture changes, the color impression for a human observer remains the same.

BRIEF DESCRIPTION OF THE DRAWINGS

These and other aspects, features and advantages of the present invention will be further explained by the following description with reference to the drawings, in which same reference numerals indicate same or similar parts, and in which.

DETAILED DESCRIPTION OF THE INVENTION

Figure 1:
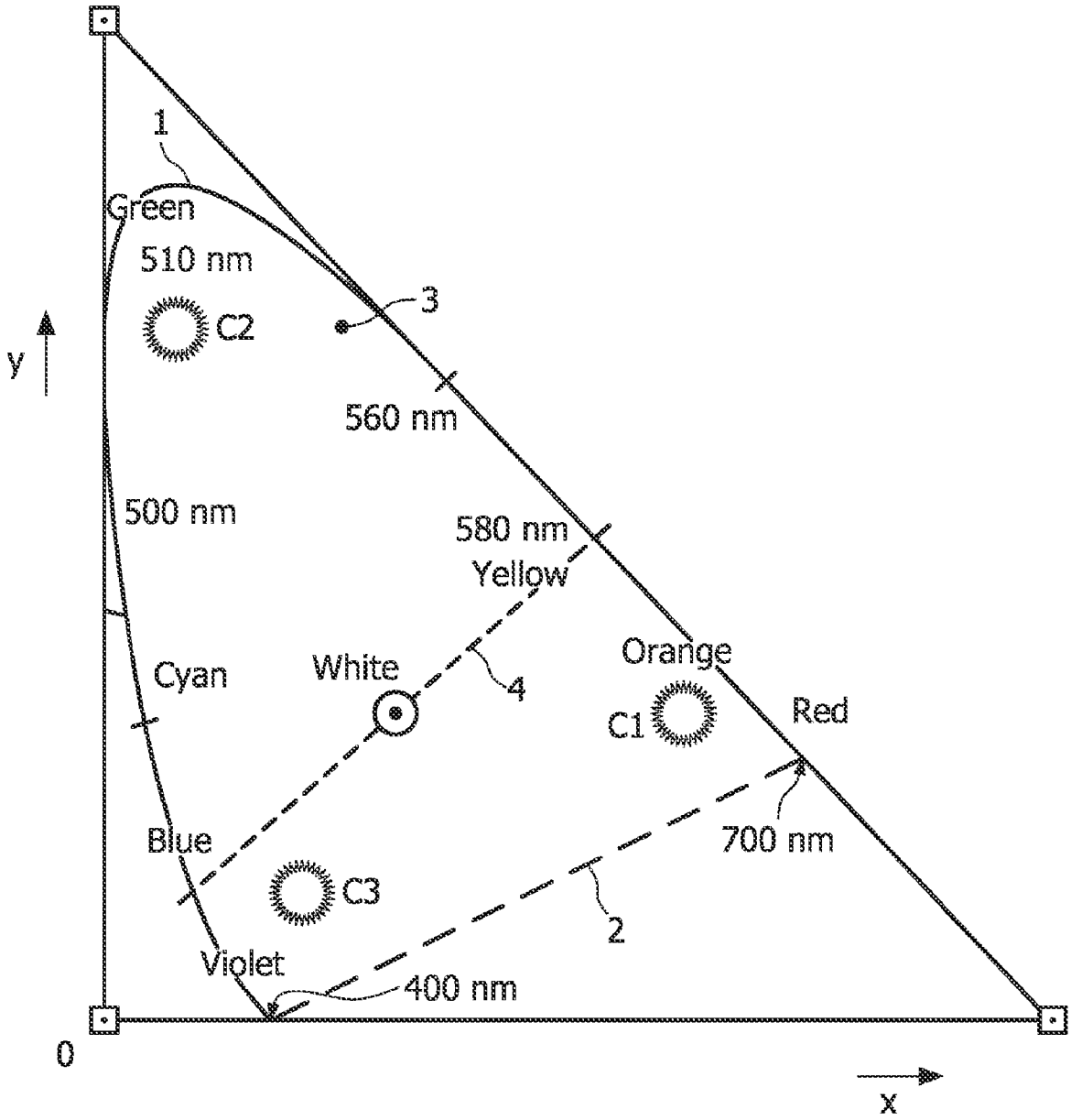
FIG. 1 schematically shows a chromaticity diagram.

FIG. 1 schematically shows an xy chromaticity diagram. This diagram is well-known, therefore an explanation will be kept to a minimum. Points (1,0), (0,0), and (0,1) indicate ideal red, blue and green, respectively, which are virtual colors. The curved line 1 represents the pure spectral colors. Wavelengths are indicated in nanometers (nm). A dashed line 2 connects the ends of the curved line 1. The area 3 enclosed by the curved line 1 and dashed line 2 contains all visible colors; in contrast to the pure spectral colors of the curved line 1, the colors of the area 3 are mixed colors, which can be obtained by mixing two or more pure spectral colors. Conversely, each visible color can be represented by coordinates in the chromaticity diagram; a point in the chromaticity diagram will be indicated as a "color point".

It is noted that a different graphical color representation, for instance the RGB chromaticity diagram, may also be used, as should be clear to a person skilled in this art.

When two pure spectral colors are mixed, the color point of the resulting mixed color is located on a line connecting the color points of the two pure colors, the exact location of the resulting color point depending on the mixing ratio (intensity ratio). For instance, when violet and red are mixed, the color point of the resulting mixed color purple is located on the dashed line 2. Two colors are called "complementary colors" if they can mix to produce white light. For instance, FIG. 1 shows a line 4 connecting blue (480 nm) and yellow (580 nm), which line crosses the white point, indicating that a correct intensity ratio of blue light and yellow light will be perceived as white light. It is noted that the light mixture actually still contains two spectral contributions at different wavelength. The same would apply for any other set of complementary colors: in the case of the corresponding correct intensity ratio, the light mixture will be perceived as white light.

If the light intensity of two complementary colors (lamps) is indicated as I1 and I2, respectively, the overall intensity Itot of the mixed light will be defined by I1+I2, while the resulting color will be defined by the ratio I1/I2. For instance, assume that the first color is blue at intensity I1 and the second color is yellow at intensity I2. If I2=0, the resulting color is pure blue, and the resulting color point is located on the curved line 1. If I2 is increased, the color point travels the line 4 towards the white point. As long as the color point is located between pure blue and white, the corresponding color is still perceived as blue-ish, but closer to the white point the resulting color would be paler.

In the following, the word "color" will be used for the actual color in the area 3, in association with the phrase "color point". The "impression" of a color will be indicated by the word "hue"; in the above example, the hue would be blue. It is noted that the hue is associated with the spectral colors of the curved line 1; for each color point, the corresponding hue can be found by projecting this color point onto the curved line 1 along a line crossing the white point.

Further, the fact whether a color is a more or less pale hue will be expressed by the phrase "saturation". If a color point is located on the curve 1, the corresponding color is a pure spectral color, also indicated as a fully saturated hue (saturation=1). As the color point travels towards the white point, the saturation decreases (less saturated hue or paler hue); in the white point, the saturation is zero, per definition.

It is noted that many visible colors can be obtained by mixing two colors, but this does not apply for all colors, as can easily be seen from FIG. 1. In order to be able to produce light having any desired color, three lamps producing three different colors are needed. More lamps may be used, but that is not necessary.

Figure 2:
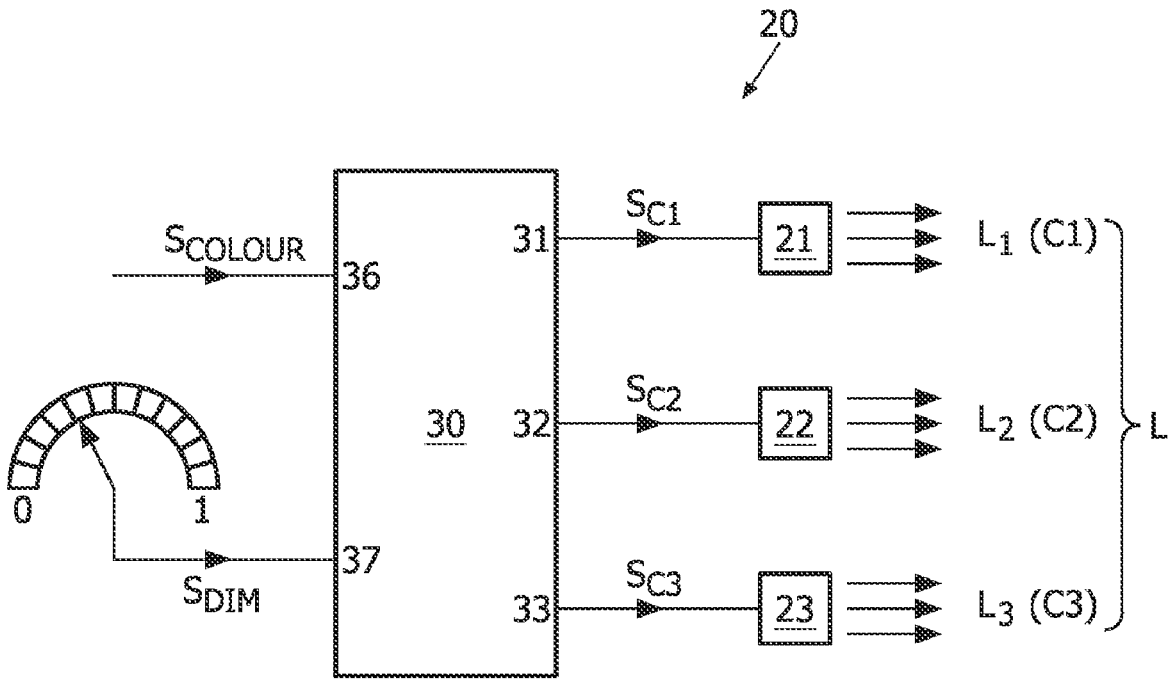
FIG. 2 is a block diagram schematically showing an illumination system.

FIG. 2 is a block diagram schematically showing an illumination system 20, comprising three fluorescent lamps 21, 22, 23 and a control system 30. The first lamp 21 generates first light L1 having a first color C1; the second lamp 22 generates second light L2 having a second color C2; the third lamp 23 generates third light L3 having a third color C3, wherein the three colors C1, C2, C3 of the three lights L1, L2, L3 are mutually different. For the sake of explanation, it may be considered that each lamp 21, 22, 23 generates spectrally pure light having substantially only one wavelength (or having only a narrow spectrum). In practice, however, a fluorescent lamp does not generate light of only one wavelength, and its color will not be a color on the curve 1 but a color somewhere within the area 3. In a suitable embodiment, the first color C1 is a red color, the second color C2 is a green color, the third color C3 is a blue color, as shown in an exaggerated manner in FIG. 1.

The first lamp 21 has a nominal light intensity indicated as Inom(1). Likewise, the second lamp 22 has a nominal light intensity indicated as Inom(2), and the third lamp 23 has a nominal light intensity indicated as Inom(3). These three nominal light intensities may be mutually equal, but this is not necessary. Instead of light output intensity, it is also possible to refer to electrical power consumption.

Each of said lamps 21, 22, 23 is a dimmable lamp, i.e. capable of receiving a dim control signal for setting the actual level of the output light intensity I1, I2, I3, respectively.

The control system 30 has a first output 31 for generating a first control signal Sc1 for controlling the intensity of the first light of the first lamp 21. In response to receiving the first control signal Sc1, the first lamp 21 operates in a dimmed condition defined by a first lamp dim factor δ1 between 0 and 1, such that the actual output light intensity I1 can be written as:

$$I1=\delta 1\cdot Inom(1) \quad (1)$$

Obviously, the dim factor δ1 is a function of the control signal Sc1.

Similarly, the control system 30 has a second output 32 for generating a second control signal Sc2 for controlling the intensity of the second light of the second lamp 22, and a third output 33 for generating a third control signal Sc3 for controlling the intensity of the third light of the third lamp 23. In response to receiving the second control signal Sc2, the second lamp 22 operates in a dimmed condition defined by a second lamp dim factor δ2, such that the actual output light intensity I2 can be written as:

$$I2=\delta 2\cdot Inom(2) \quad (2)$$

In response to receiving the third control signal Sc3, the third lamp 23 operates in a dimmed condition defined by a third lamp dim factor δ3, such that the actual output light intensity I3 can be written as:

$$I3=\delta 3\cdot Inom(3) \quad (3)$$

The overall output light of the illumination system 20 is indicated at L, and is a mixture of the three lights L1, L2, L3. From the earlier explanation, it should be clear that the color point of the combined output light L is determined by the three actual output light intensities I1, I2, I3. The control system 30 has a first user control input 36 for receiving a user control signal $S_{COLOUR}$ with which a user may set the color point of the output light of the illumination system 20. The control system 30 is adapted to generate its output control signals Sc1, Sc2, Sc3 in such a way that the individual intensities of the individual lamps 21, 22, 23 have the correct mutual ratios corresponding to the required color point. The relationship between the input color point and the corresponding output control signals Sc1, Sc2, Sc3 is defined by lamp setting factors α1, α2, α3, which may be stored in a memory of the control system 30. If desired, the control system 30 may have light detectors associated with the individual lamps 21, 22, 23 to monitor the corresponding light intensities I1, I2, I3 and to adapt the corresponding output control signals Sc1, Sc2, Sc3 if necessary, but this is not shown in the figure.

The control system 30 has a second user control input 37 for receiving a user control signal $S_{DIM}$ with which a user may dim the output light of the illumination system 20. The nature of the dim control signal $S_{DIM}$ is not relevant; by way of illustration, the dim control signal $S_{DIM}$ is assumed to indicate a continuously variable system dim factor β within a range from a maximum setting indicated as "1" to a minimum setting indicated as "0". The user's intention, when changing the dim control signal $S_{DIM}$, is that the overall light intensity of the combined output light L of the system 20 is changed but the color point is maintained. This could graphically be illustrated by adding a third axis representing intensity and extending perpendicular to the plane of FIG. 1: the user's intention would then correspond to traveling a line parallel to said third axis down to intensity zero.

Based on the color setting (defined by the lamp setting factors α1, α2, α3) and the dim setting (defined by the system dim factor β), the control system 30 calculates the individual lamp dim factors δ1, δ2, δ3 in accordance with the following formulas:

$$\delta 1=\beta\cdot\alpha 1 \quad (4)$$

$$\delta 2=\beta\cdot\alpha 2 \quad (5)$$

$$\delta 3=\beta\cdot\alpha 3 \quad (6)$$

and generates its output control signals Sc1, Sc2, Sc3 correspondingly.

With respect to the setting of the color point, it is noted that this setting does not change if the individual light intensities of all lamps 21, 22, 23 are multiplied by the same factor β. Among the three individual lamp setting factors α1, α2, α3, normally one will have the highest value, while the other two will have lower values (although it may happen that two of said factors are equally high while the third factor is lower). Therefore, it is possible to scale these three dim factors such that the value of said one dim factor is equal to 1; since these scaled values correspond to the situation with the highest overall light intensity of the system output light L with β=1, it will be assumed that these scaled values are the values as stored in the said memory of the control system. In the following explanation, it will be assumed that α3=1 and that α2<1 and α1<1.

Figure 3:
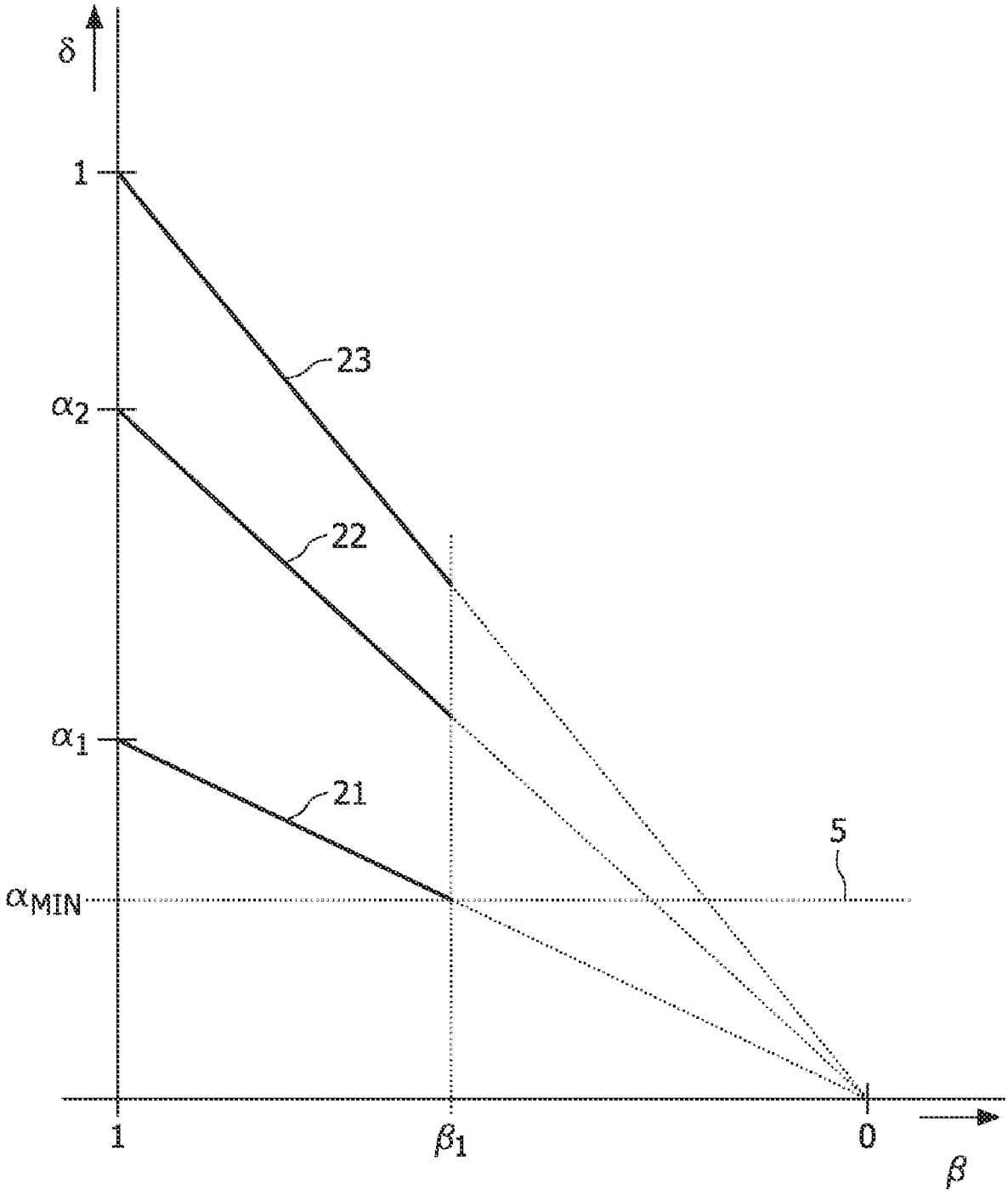
FIG. 3 is a graph illustrating a relationship between a system dim factor β and individual lamp dimming factors.

FIG. 3 is a graph illustrating the relationship between the system dim factor β (horizontal axis) and the three individual lamp dimming factors δ1, δ2, δ3 (vertical axis).

Since the three individual lamp dimming factors δ1, δ2, δ3 are all multiplied by the same factor β, the color point does not shift when the overall intensity is reduced (traveling towards the right in FIG. 3). In an ideal case, the overall intensity reaches zero when β reaches zero. However, a practical problem exists in that the lamps have a physically determined lower dim limit $I_{MIN}$, corresponding to a lower limit of the lamp dim factor $\delta_{MIN}=I_{MIN}/Inom$. This lower limit is shown in FIG. 3 as a horizontal broken line 5. It is noted that the three lamps 21, 22, 23 may have mutually different lower dim limits, but this is not illustrated in the figure. For the sake of argument, it will be assumed hereinafter that the lower dim limit $I_{MIN}$ is equal for all lamps.

FIG. 3 shows that the first lamp 21 reaches its lower dim limit $\delta_{MIN}$ when the system dim factor β reaches a value β1. If the user reduces the system dim factor β still further, the control system 30 can not comply by reducing the light intensity of this third lamp. A conventional control system 30 will therefore maintain the setting of its output control signals so that the light is not dimmed beyond β1, even if the user reduces the system dim factor β below β1. In other words, the effective dim range for this setting of the color point is from β=1 to β=β1.

According to a first aspect of the present invention, dimming of the system is continued with the intensity of the first lamp 21 being maintained at its minimum dim level. It is possible to continue dimming in accordance with the formulas (5) and (6), accepting a small change in the location of the color point. However, in a preferred embodiment, the present invention proposes to continue dimming with constant hue. To the user, the most important effect is that the light intensity is reduced indeed, as requested by the user, while the change in color point is hardly noticeable since the hue is maintained.

As explained in the above, changing a color point while maintaining the hue can be visualized as traveling a straight line towards the white point in the chromaticity diagram. In formulas, this can be expressed as follows:

$$\delta 1=\beta 1\cdot\alpha 1 \text{ for } \beta<\beta 1 \quad (7)$$

$$\delta 2=\lambda(\beta)\cdot 2 \text{ for } \beta<\beta 1 \quad (8)$$

$$\delta 3=\mu(\beta)\cdot\alpha 3 \text{ for } \beta<\beta 1 \quad (9)$$

Note that the first intensity I1 is maintained constant, and that the second and third lamps 22 and 23 are dimmed by factors λ and μ which are functions of β, which are chosen such that λ(β1)=β1 and μ(β1)=β1 and such that these functions in combination define a line of constant hue. The precise functions depend, of course, on the original color point. Note that, depending on the location of the original color point, said factors λ and μ may be scaled such that one of these factors is always equal to β.

In principle, it is possible to continue until the next lamp reaches its minimum dim level, or until the white point is reached. However, by that time the user may have noticed that the color has changed. Therefore, in a preferred embodiment, the further dimming process is stopped before the white point is reached. An end point for the further dimming process may be defined simply by defining an end value $\beta_{END}<\beta 1$: if the dim factor β reaches this end value $\beta_{END}$, further dimming in response to a further lowering of the system dim factor β is inhibited. In a preferred embodiment, however, an end condition is defined in terms of saturation: the further dimming is inhibited if the saturation, which will be indicated by ζ, has reached a predefined threshold value $\zeta_T$. In a preferred embodiment, $\zeta_T$ is chosen to be equal to 0.5.

Said predefined threshold value $\zeta_T$ will be reached for a certain value $\beta_T$ of the dim factor β, $\beta_T$ being lower than β1. Thus, the effective dim range is now from β=1 to $\beta=\beta_T$: according to the invention, the effective dim range has been extended beyond β1.

Figure 4:
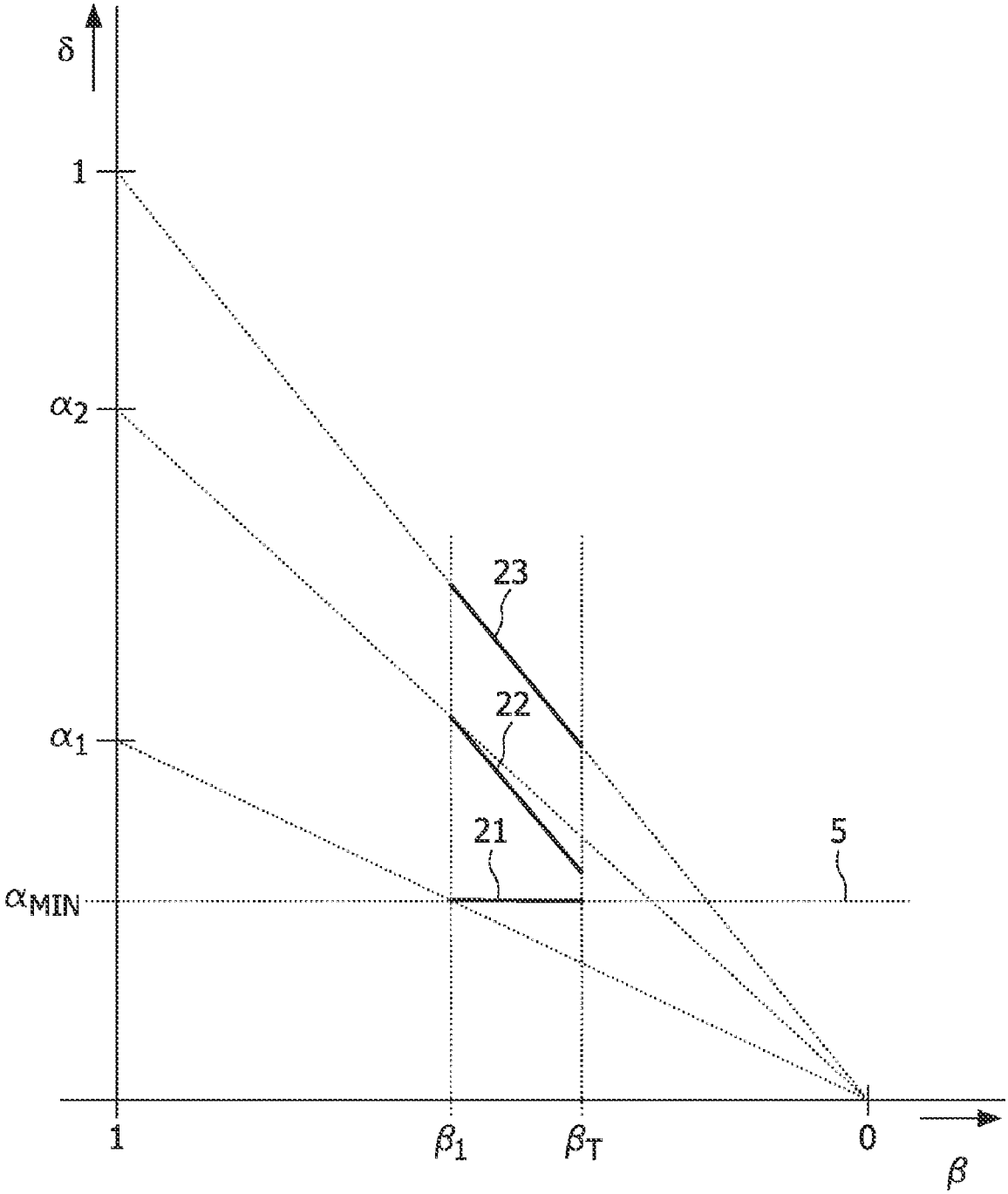
FIG. 4 is a graph comparable to FIG. 3, illustrating extended dimming.

FIG. 4 is a graph comparable to FIG. 3, illustrating the extended dimming. The figure shows that, for $\beta_T<\beta<\beta 1$, the intensity I1 of the first lamp 21 is maintained constant, the intensity I3 of the third lamp 23 is dimmed by the dim factor β, and the intensity I2 of the second lamp 22 is dimmed by a factor λ(β)<β.

Figure 5:
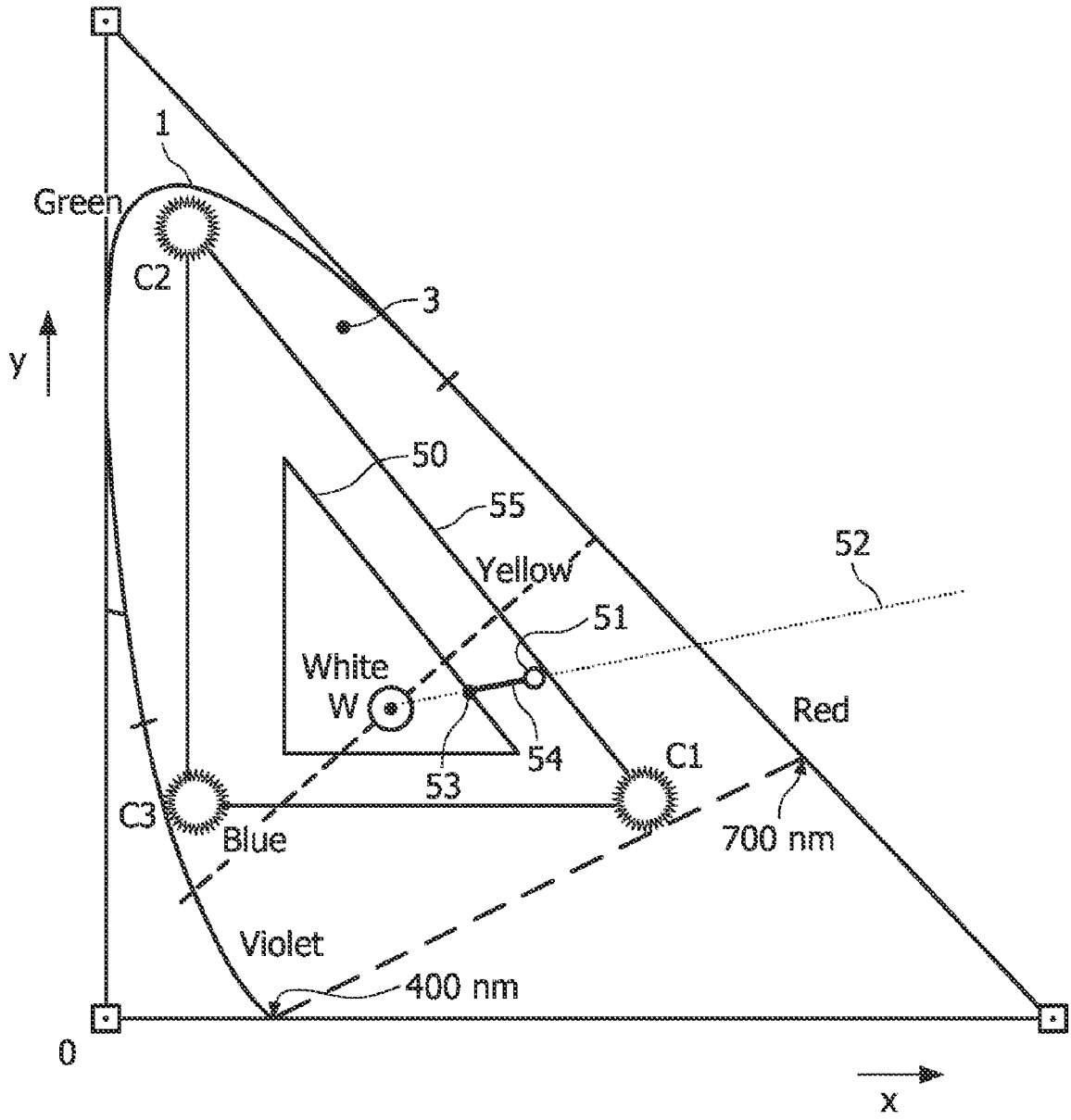
FIG. 5 is a graph comparable to FIG. 1, illustrating an end condition for the extended dimming.

FIG. 5 is a graph comparable to FIG. 1. Triangle 55 having its corners coinciding with the color points C1, C2, C3 of the three lamps 21, 22, 23 defines the area of all colors that can be made with these three lamps. A line 50 connects all color points with saturation ζ=0.5. An original color point is indicated at 51, the white point is indicated at W. A dotted line 52 connecting color point 51 with white point W defines all colors having the same hue as the color point 51. This dotted line 52 intersects the line 50 at intersection 53. The solid line 54 indicates the trajectory traveled by the color point of the output light L of the illumination system 20 when the dim factor β is lowered from β1 to $\beta_T$ in accordance with the present invention.

It is noted that in the above reference is made to the white point, indicating that there is only one white point. Depending on definition, the location of the white point may vary. Alternatively, it is possible to define a white point and, for the above explanation, to use a point W in close proximity but not necessarily identical to the defined white point.

It is further noted that the saturation may be defined in relation to the pure colors of curve 1. This will be indicated by the phrase "absolute saturation". In such case, a line 50 connecting all points of 50% absolute saturation would have a shape corresponding to the shape of curve 1. Such an interpretation of saturation corresponds to one embodiment of the invention. In the above explanation and in FIG. 5, however, the saturation is defined in relation to the boundary 55 of the area of all colors that can possibly be made with the particular lamps 21, 22, 23 of the actual system: this will be indicated by the phrase "relative saturation". Said boundary 55, which in the case of three lamps is a triangle, corresponds to 100% relative saturation (but less than 100% absolute saturation), and the line 50 connecting all points of 50% relative saturation has a shape corresponding to the shape of boundary 55, as shown.

It is noted that the amount of extension offered by the present invention depends on the location of the original color point. If this color point is close to the said boundary 55, as shown in FIG. 5, the relative intensity of one of the lamps is relatively low, and this lamp will reach its minimum dim level relatively early, thus resulting in a relatively narrow dim range [1; β1]. At the same time, the relative saturation ζ of the original color point will be close to 1, and the dim factor β can be lower substantially before reaching $\beta_T$. If the original color point already has a relative saturation ζ close to 0.5, the "original" dim range [1; β1] will already be relatively wide, and the extension offered by the present invention will be relatively small. Importantly, to the perception of the user, the effective dim range [1; $\beta_T$] will be more or less the same for colors close to the said boundary 55 and colors further away from the said boundary 55.

It should be clear to a person skilled in the art that the present invention is not limited to the exemplary embodiments discussed above, but that several variations and modifications are possible within the protective scope of the invention as defined in the appending claims.

For instance, instead of a predetermined saturation ζT (absolute or relative) equal to a fixed value such as 50%, a different definition may be used, for instance a curve (e.g. a circle) around the white point W or a point close to the white point.

Further, application of the invention is not limited to systems having three light sources: the principles of the present invention also apply in the case of a system with four or more light sources.

In the above, the present invention has been explained for the problem that the lamps (or at least one of the lamps) have a lower dim limit: further decreasing the light intensity of such lamp below its lower dim limit is not possible. However, lamps also have an upper dim limit: further increasing the light intensity of such lamp above its upper dim limit is not possible (at least not without damage to the lamp). Usually, this upper dim limit is somewhat above the nominal light intensity, but usually control is such that the lamps have a practical upper limit equal to their nominal light intensity, in order to prevent damage. For such situation, the principles of the invention also apply: the light intensity of this one lamp is kept constant while the light intensity of all other lamps is increased in such a way that the hue is kept constant. Since the phrase "dimming" suggests "reducing light intensity", the phrase "changing light intensity in a certain direction" will be used, wherein the "certain direction" can be either "increase" or "decrease". For the case of increasing the light intensity, it is also possible to define a predetermined threshold saturation value ($\zeta_T$) lower than 100%, but in practice this is not necessary.

In the above, the present invention has been explained with reference to block diagrams, which illustrate functional blocks of the device according to the present invention. It is to be understood that one or more of these functional blocks may be implemented in hardware, where the function of such functional block is performed by individual hardware components, but it is also possible that one or more of these functional blocks are implemented in software, so that the function of such functional block is performed by one or more program lines of a computer program or a programmable device such as a microprocessor, microcontroller, digital signal processor, etc.

The invention claimed is:

1. A method for changing light intensity in a certain direction of an illumination system capable of emitting light (L) with a variable color, the illumination system comprising at least three dimmable light sources generating respective lights having respective, mutually different colors;

the method including the steps of;

calculating lamp setting factors (α1, α2, α3) on the basis of said user input signal for said light sources;

calculating a system dim factor (β) on the basis of a user input dim signal ($S_{DIM}$);

determining a first dim limit value (β1) for which said one light source (21) reaches a dim limit ($I_{MIN}$), wherein β1 represents said first dim limit value, α1 represents the lamp setting factor for said one light source, $I_{MIN}$ represents the dim limit of said one light source, and Inom represents a nominal intensity of said one light source;

calculating lamp dim factors (δ1, δ2, δ3) as the product of the system dim factor (β) and said lamp setting factors (α1, α2, α3), generating control signals such that all dimmable light sources are dimmed by said calculated lamp dim factors (δ1, δ2, δ3);

changing the light intensities of all dimmable light sources in said certain direction while maintaining the color point until one of said light sources reaches said dim limit ($I_{MIN}$);

maintaining the light intensity of said one light source at its dim limit ($I_{MIN}$) and changing the light intensities of the other dimmable light sources in the same certain direction in such a manner that the hue is maintained;

wherein the light intensities of the said other dimmable light sources are changed in said certain direction until the absolute or relative saturation (ζ) reaches a predetermined threshold value ($\zeta_T$)';

wherein said certain direction is a decrease of intensity and said predetermined threshold saturation value ($\zeta_T$) is approximately equal to 0.5.

2. Illumination system for generating mixed light (L), comprising at least three dimmable light sources for generating respective lights having respective, mutually different colors, each light source having a nominal intensity (Inom(1), Inom(2), Inom(3)), at least one of said light sources having a dim limit ($I_{MIN}$);

a control system for generating control signals (Sc1, Sc2, Sc3) for controlling the dimmable light sources; the control system having a first input for receiving a first user input signal ($S_{COLOUR}$) defining a color point and having a second input for receiving a second user input dim signal ($S_{DIM}$);

wherein the control system is configured to calculate lamp setting factors ($\alpha 1$, $\alpha 2$, $\alpha 3$) on the basis of the first user input signal ($S_{COLOUR}$);

wherein the control system is configured to calculate a system dim factor ($\beta$) on the basis of the second user input dim signal ($S_{DIM}$);

wherein the control system is configured to calculate a first dim limit value ($\beta 1$) for which said one light source reaches its dim limit ($I_{MIN}$), according to the formula $$\beta 1 = I_{MIN}/(\alpha 1 \cdot Inom(1)),$$

wherein $\beta 1$ represents said first dim limit value, wherein $\alpha 1$ represents the lamp setting factor for said one light source, wherein $I_{MIN}$ represents the dim limit of said one light source, and wherein Inom(1) represents the nominal intensity of said one light source;

wherein the control system is configured, as long as the system dim factor ($\beta$) has not reached the first dim limit value ($\beta 1$), to calculate lamp dim factors ($\delta 1$, $\delta 2$, $\delta 3$) as the product of the system dim factor ($\beta$) and the lamp setting factors ($\alpha 1$, $\alpha 2$, $\alpha 3$), and to generate its control signals (Sc1, Sc2, Sc3) such that all dimmable light sources are dimmed by the calculated lamp dim factors ($\delta 1$, $\delta 2$, $\delta 3$);

wherein the control system is configured, if the system dim factor ($\beta$) reaches the first dim limit value ($\beta 1$), to calculate the lamp dim factor ($\delta 1$) for said one light source as the product of said first dim limit value ($\beta 1$) and the first lamp setting factor ($\alpha 1$), and to calculate the lamp dim factors ($\delta 2$, $\delta 3$) of the other dimmable light sources such as to change the intensity of said other dimmable light sources in a certain direction while maintaining the hue of the mixed light (L)

wherein the control system is configured to continue changing the intensity of said two other dimmable light sources in said certain direction until the system dim factor ($\beta$) reaches a second dim limit value ($\beta 2$) where the absolute or relative saturation ($\zeta$) of the mixed light (L) has a predefined threshold value ($\zeta_T$);

wherein said certain direction is a decrease of intensity and said predefined saturation threshold value ($\zeta_T$) is approximately equal to 0.5.

3. A method for changing light intensity in a certain direction of an illumination system capable of emitting light with a variable color, comprising:

providing at least three dimmable light sources for generating respective light having respective mutually different colors, each light source having a nominal intensity, at least one of said light sources having a dim limit ($I_{MIN}$);

receiving a first user input signal $S_{COLOUR}$ defining a color point receiving a second user input dim signal ($S_{DIM}$);

calculating lamp setting factors $\alpha 1$, $\alpha 2$, $\alpha 3$ on the basis of said first user input signal $S_{COLOUR}$ for said color point;

calculating a system dim factor $\beta$ on the basis of said second user input dim signal $S_{DIM}$;

determining a first dim limit value $\beta 1$ for which said one light source reaches a dim limit $I_{MIN}$;

wherein $I_{MIN}$ represents the dim limit of said one light source; and so long as the system dim factor $\beta$ has not reached said first dim limit value $\beta 1$, calculating lamp dim factors $\delta 1$, $\delta 2$, $\delta 3$ as the product of the system dim factor $\beta$ and said lamp setting factors $\alpha 1$, $\alpha 2$, $\alpha 3$, and generating control signals Sc1, Sc2, Sc3 such that all dimmable light sources are dimmed by said calculated lamp dim factors $\delta 1$, $\delta 2$, $\delta 3$;

wherein when said system dim factor $\beta$ reaches said first dim limit value $\beta 1$, calculating said lamp dim factor $\delta 1$ for said one light source as the product of said first dim limit value $\beta 1$ and said first lamp setting factor $\alpha 1$, and calculating said lamp dim factors $\delta 2$, $\delta 3$ of the other dimmable light sources such as to change the intensity of said other dimmable light sources in a certain direction while maintaining the hue of the mixed light (L);

changing the intensity of said other dimmable light sources in said certain direction until the system dim factor $\beta$ reaches a second dim limit value $\beta 2$ where the absolute or relative saturation $\zeta$ of the mixed light (L) has a predefined threshold value $\zeta_T$;

wherein said certain direction is a decrease of intensity and said predefined saturation threshold value ($\zeta_T$) is approximately equal to 0.5.

* * * * *